United States Patent [19]

Uyehara

[11] Patent Number: 4,662,552

[45] Date of Patent: May 5, 1987

[54] BATON HOLDER

[76] Inventor: James H. Uyehara, 1632 Michael La., Pacific Palisades, Calif. 90272

[21] Appl. No.: 750,768

[22] Filed: Jul. 1, 1985

[51] Int. Cl.[4] ..... A45F 5/00

[52] U.S. Cl. ..... 224/251; 224/253; 224/914

[58] Field of Search ..... 224/914, 922, 252, 253, 224/219, 911, 197; 273/84 R

[56] References Cited

U.S. PATENT DOCUMENTS

| | | | |
|---|---|---|---|
| 372,000 | 10/1887 | Wintz | 224/914 X |
| 454,770 | 6/1891 | Robinson | 224/914 X |
| 710,236 | 9/1902 | Audley | 224/914 X |
| 2,781,958 | 2/1957 | Lewandowski | 224/922 X |
| 2,954,909 | 10/1960 | Miller et al. | 224/922 X |
| 3,261,519 | 7/1966 | Horne | 224/911 X |
| 3,268,130 | 8/1966 | Simpson | 224/911 X |
| 3,273,766 | 9/1966 | Cosentino | 224/219 X |
| 3,550,824 | 12/1970 | Bohanski | 224/219 X |
| 4,006,851 | 2/1977 | Kippen | 224/914 X |
| 4,081,116 | 3/1978 | Fliegelman et al. | 224/253 X |
| 4,365,808 | 12/1982 | Perez | 273/84 R |
| 4,479,171 | 10/1984 | Mains | 273/84 R X |
| 4,529,112 | 7/1985 | Miller | 224/922 X |
| 4,572,415 | 2/1986 | Fehr | 224/914 X |

FOREIGN PATENT DOCUMENTS

| | | | |
|---|---|---|---|
| 871563 | 5/1971 | Canada | 224/914 |

*Primary Examiner*—Stephen Marcus
*Assistant Examiner*—Robert W. Petrik
*Attorney, Agent, or Firm*—Bogucki, Scherlacher, Mok & Roth

[57] ABSTRACT

A holder for a law enforcement baton, of the type having a side handle, includes a belt mounted base to which a cylindrical sleeve, having a central axial aperture, is mounted so as to be pivotable in a vertical plane when the holder is mounted on the belt of a law enforcement officer. A side-handled baton is inserted with its principal length in the axial aperture, and the side handle snaps between a pair of resilient tangs that are forced to part by the side handle under manual force to receive the side handle in a mating socket. The sleeve member is frictionally restrained but can be pivoted by manual force to any desired attitude. The baton then remains in stable position while the user is walking, running, crouching or seated in a patrol car. Nonetheless, the baton is accessible and may be removed from the holder under reasonable manual force, instantaneously, if needed.

17 Claims, 13 Drawing Figures

BATON HOLDER

BACKGROUND OF THE INVENTION

This invention pertains to law enforcement devices, and particularly to devices for enabling police batons to be carried in a convenient, versatile manner.

Over the years, as law enforcement has been studied and approved procedures devised, the traditional "night stick" or baton has evolved into a longer, heavier, largely standardized instrument for defensive and control purposes. Approximately 10 years ago, law enforcement agencies began to change over from the straight baton to a side handle version, having a number of significant advantages. This baton is approximately 24 inches in length and includes a first handle, in line with the principal axis of the baton, that is approximately 6 inches in length, and a side handle of 5 or 6 inches in length that protrudes at right angles at the starting point for the in-line handle.

Preferred methods of carrying, withdrawing and utilizing the side-handled baton have been devised for a number of defensive and control situations, and officers are taught these procedures systematically. The side handle affords substantial versatility in undertaking different movements with the baton, as well as giving the officer a two-handled grip and leverage against someone seizing the baton from the opposite end. Existing side handle batons are offered in two different length, weight and diameter configurations that are quite alike but, nevertheless, differ.

In practice, law enforcement officers have been carrying the side handle batons by inserting them into rings suspended from their heavy gunbelt, but this has been found to present a substantial number of problems in different situations. If the officer is merely walking along, then the ring support provides little interference and the baton extends substantially vertically with its principal length not interfering with motion. If the officer begins to run, however, the baton bounces up and down in the ring and begins to swing back and forth, sometimes hitting against the officer's leg or knee. To prevent this, the officer must hold the baton at an end or in the center, thus limiting flexibility of movement and reducing the officers capability for self-defense. Any situation in which the officer is required to have one hand on the baton while it is in the ring support places the officer at a disadvantage because someone can seize either the baton handle or the officer's hand to substantially immobilize him or her.

Further, officers riding in patrol cars find the ring holder extremely inconvenient, because the length of the baton presents an interference within the front passenger compartment. The common response then is to remove the baton from the ring holder and place it either on the seat or on the floor of the patrol car, where it can be forgotten or unavailable in an emergency situation in which the officer must respond immediately. The ring support is also inconvenient for use when the office must crouch or crawl, because the baton then interfers with the body or bangs against the ground, requiring that the officer control the baton by hand to limit interfering motion and maintain silence, which may be of paramount importance in some instances.

SUMMARY OF THE INVENTION

A baton holder in accordance with the invention is mounted on the belt of a law enforcement officer by a support on which a sleeve member is rotatably mounted, but frictionally restrained, about an axis which is horizontal to the ground and perpendicular to the officer's side when the officer is standing. The sleeve incorporates an axial aperture through which the principal length of the baton extends, and a side socket conforming to and receiving the side handle which may be inserted and removed through an opening between a pair of resilient, opposed tangs adjacent to the side socket. The frictional restraint of the pivotable sleeve is sufficient to retain the weight of the baton and sleeve in any attitude, but the baton can still be conveniently changed in attitude by manual force. The side handle tangs which retain the baton at the side handle socket maintain the baton in position in any attitude, but also can be overcome by reasonable manual force exerted by the wearer. The baton thus can be put in a number of principal positions for use under different circumstances. Its principal length can extend vertically downward for use in normal walking. When running, the officer can shift the baton to a position such as its principal length is substantially horizontal, perpendicular to the officer's body. To sit in a patrol car or to leave both hands free when crawling through a constricted space or maintaining a low profile, the officer can rotate the baton so that its principal length extends upwardly along the officer's body, with its tip adjacent to the shoulder.

In accordance with specific aspects of the invention, the support member may comprise a rectangular member having an inner side secured flush against the belt by a fabric fastener web of the "VELCRO" type. The sleeve member is fabricated principally as a thick-walled plastic member, having a metal elevator bolt molded integrally into its side, and having a surface boss matching a corresponding surface boss on the base member. The bolt extends through an aperture in the base member and is secured on the inner side by a nut threaded onto the bolt and bearing against a friction spring of the the Belleville type, so as to provide an adjustable level of frictional restraint on the rotational movement of the sleeve. The side socket is adjacent to one end of the sleeve member and open at that end through the opposed tangs which fit around and secure the side handle. A slot in the sidewall of the side handle, in communication with the side socket and on the opposite side from the tangs, is incorporated to facilitate the spreading action of the sleeve member, so that it yields to the desired extent when the side handle is slipped into or removed from the inserted position with the principal length of the baton extending through the axial aperture in the sleeve member.

In accordance with another feature of the invention, the sleeve member is constructed with a pair of opposed side sockets, each bounded by a relief slot on one side and a pair of tangs at the sleeve end, which allows the wearer to choose his or her preference as to carrying the sleeve member on the right or left side of the body. In an alternative arrangement, the sleeve is configured with side sockets of different sizes at each end so that either of the two principal sizes of side handle baton currently in use can be employed.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
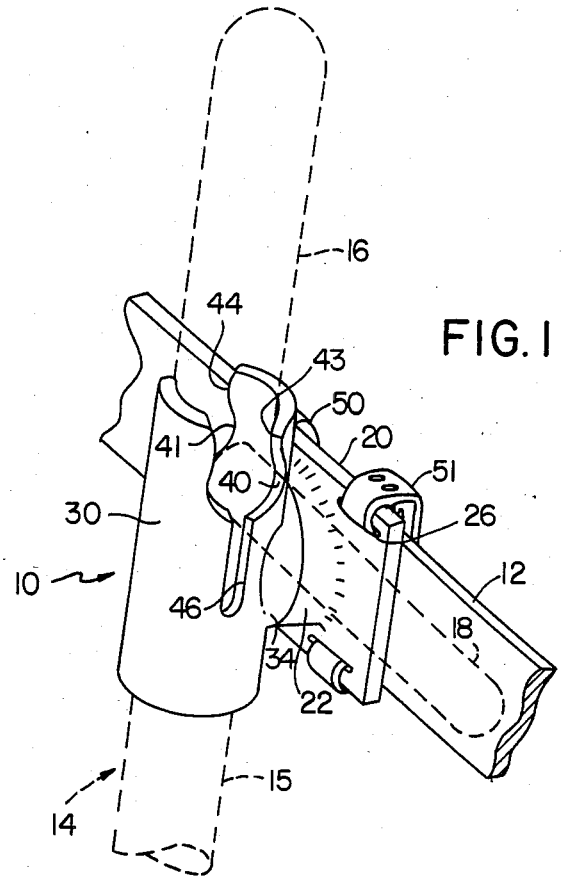
FIG. 1 is a perspective view, partially broken away, of a baton holder in accordance with the present invention as viewed from alongside an officer wearing the holder.
Figure 2:
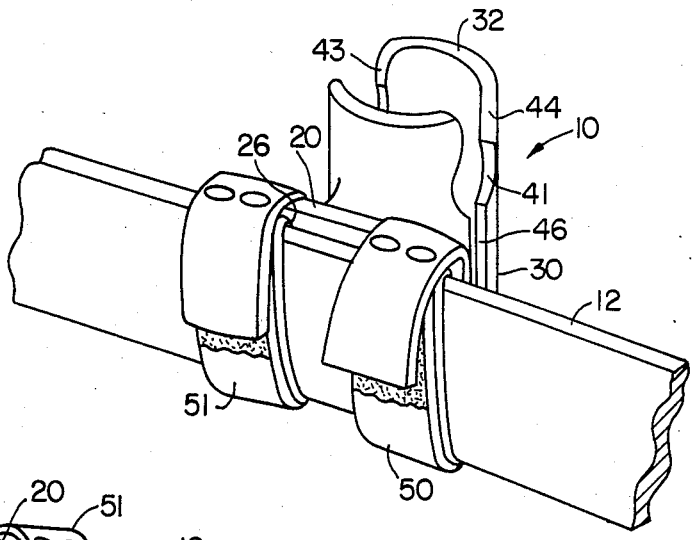
FIG. 2 is a different perspective view of the baton holder of FIG. 1, as viewed from the belt side.
Figure 3:
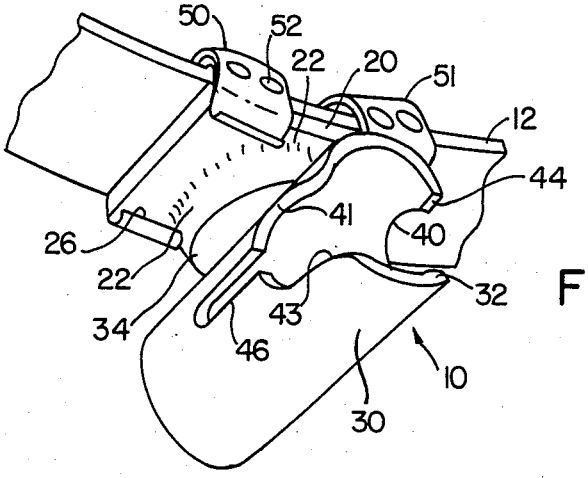
FIG. 3 is a top perspective view of the baton holder of FIGS. 1 and 2.
Figure 4:
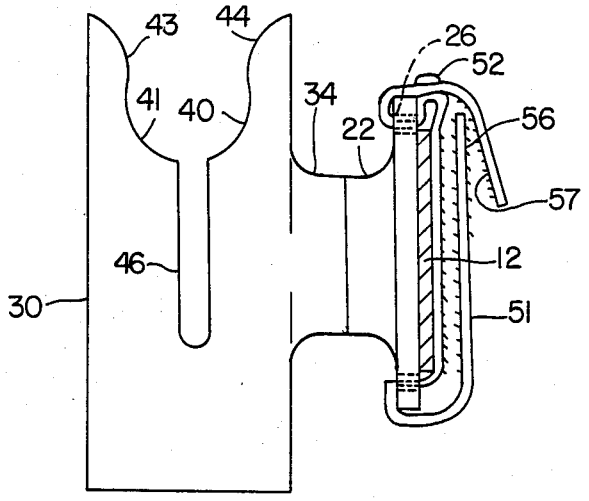
FIG. 4 is a side view of the holder of FIGS. 1–3, showing the belt securement device in section.

A baton holder 10, in accordance with the invention, referring now to FIGS. 1–5, is attachable in a releasable manner onto the belt 12 of a law enforcement officer, such belts typically being wide and of heavy leather and supporting a gun holster (not shown) or other paraphernalia. A side handle baton 14, for example, has a principal length 15 (FIG. 1 only) that terminates at one end in an in-line handle 16, and also has a side handle 18 that extends perpendicularly to the principal length 15 at the base or interior end of the in-line handle 16. Techniques of considerable sophistication have been devised for use of the baton 14 in overcoming, disabling or immobilizing offenders, in defending against impacts, and in inserting and withdrawing the baton 14.

Figure 5:
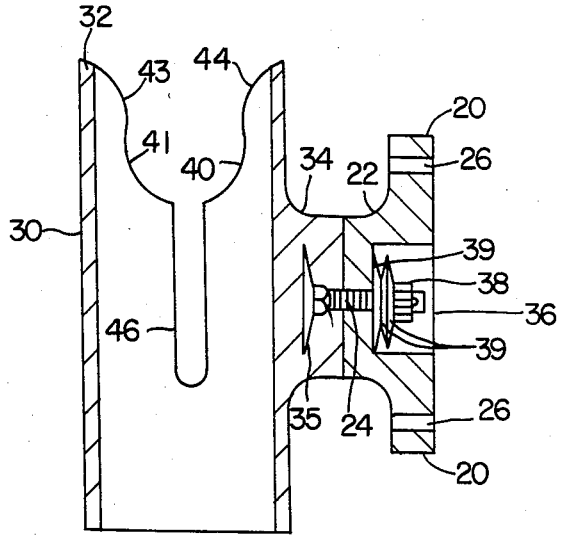
FIG. 5 is a side sectional view of the holder of FIGS. 1–3, taken along the center line thereof.

The baton holder 10 includes a base support 20, the inner side of which (relative to the wearer) fits flush against the belt 12, and the outer side of which includes a central boss 22 concentric with an axis that is substantially horizontal when the officer is standing. Slots 26 are provided through the base support 20, adjacent to and parallel to each of its upper and lower edges relative to the belt, for use in attaching the base support 20 to the belt 12. A sleeve member 30, having a hollow cylindrical shape defined by a thick wall 32 of industrial plastic or other suitable rugged by non-conducting material, includes a central axial aperture for receiving the principal length 15 of the baton 14. A protrusion or boss 34 on the outer side of the wall 32 has a flat surface matching and bearing against the base support boss 22. The boss 34 (as seen in FIG. 5 only) encompasses an elevator bolt 24 whose head end is embedded in the sleeve element 30 during molding. A threaded end of the bolt 24 extends outwardly through the boss 22 in the support 20 for attachment of the sleeve element 30 to the support 20 in rotatable fashion. The extending threaded end of the elevator bolt 24 passes through a central aperture 35 in the boss 34 and terminates within a countersink depression 36 in the base support 20. The boss 34 on the sleeve member 30 is disposed so that, when the wearer is standing, the sleeve member 30 can be rotated in a substantially vertical plane about the elevator bolt 24. Interior to the base support 20, a nut 38 is secured onto the threaded end of the elevator bolt 24, the nut being tightened against three Belleville springs 39, which fit within the countersink 36 in the base support 20. The nut 38 is accessible through an opening 37 in the backside of the base support 20.

Figure 8:
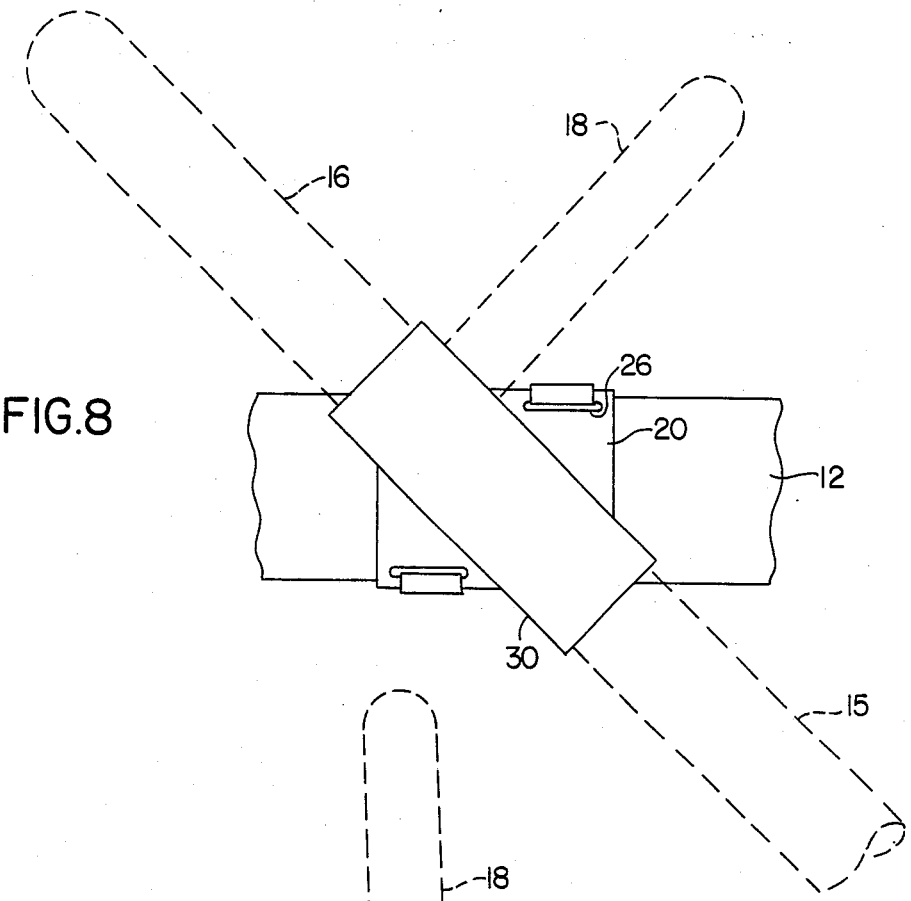
FIGS. 8 and 9 are front views of the baton holder of FIGS. 1–3, showing the baton in phantom and in different alternative positions.
Figure 9:
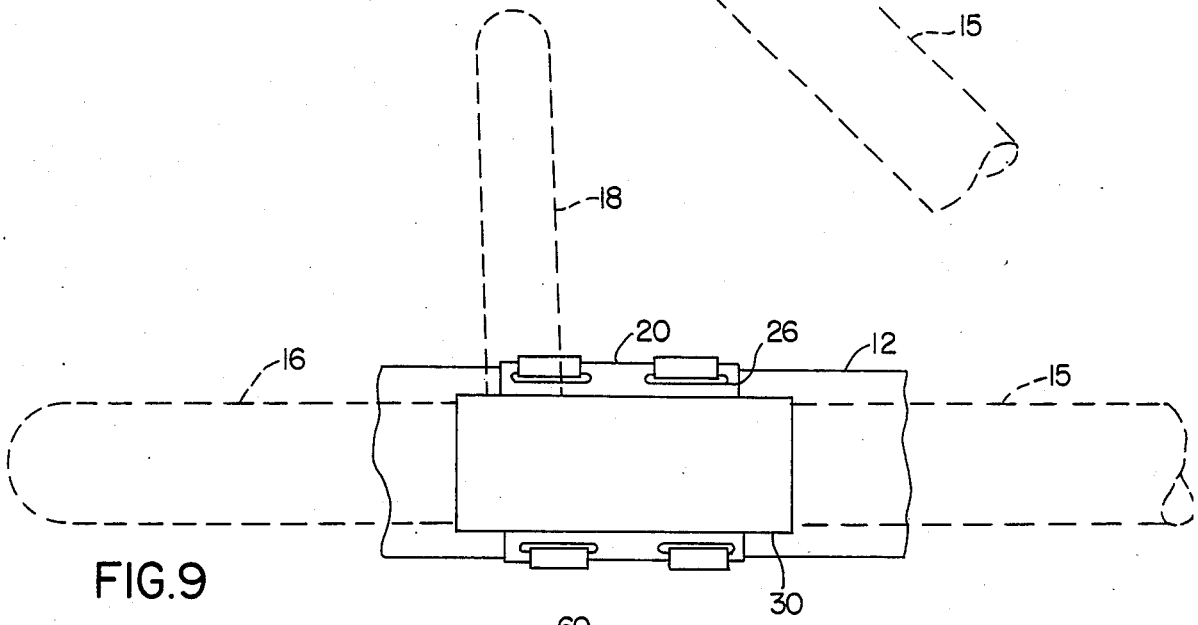

This arrangement enables adjustable tightening of the sleeve member 30 in relation to the base support 20, with a controllable frictional restraint being introduced by the compressed Belleville springs 39 between the nut 38 and the face of the countersink 36, and between the opposed faces of the two bosses 22, 34. The frictional engagement is adjusted so that the weight of the baton 14 and sleeve member 30, as well as forces encountered during ordinary walking and running do not cause shifting of the baton position regardless of the attitude in which the baton 14 is placed. However, the level of frictional restraint is also adjusted to be less than the wearer can conveniently exert manually. For shifting to different positions, as seen in FIGS. 8 and 9, the principal length 15 of the baton 14 can be employed as a lever to change the angular position of the baton 14 about the rotational axis defined by the elevator bolt 24. Single-hand operation usually suffices with proper adjustment of the nut 38 (FIG. 5).

The in-line aperture within the sleeve member 30 receives the principal length 15 of the baton 14 with a sliding fit. When the baton 14 is fully inserted, the side handle 18 is received within side sockets 40, 41 of generally circular outline provided in the side walls of the sleeve member 30, and in communication with the in-line aperture. Both side sockets 40, 41 are adjacent what may be termed the upper end of the sleeve member 30. A first side socket 40 faces rearward relative to the wearer and is usually employed for receiving the side handle 18, which then also faces rearwardly. The second side socket 41 faces frontward relative to the wearer, but is employed in the same manner when the baton holder 10 is attached to the opposite side of the belt 12. Each side socket 40, 41 is open to the upper end of the sleeve member 30 between a pair of tangs 43, 44. The spacing between these tangs 43, 44 is less, by a predetermined distance, than the diameter of the side handle 18, and the surfaces of the tangs 43, 44 merge into the outline of the circular sockets 40, 41.

The sockets 40, 41 also include downward slot extensions 46 of length and width chosen to control the compliance of the two sides of the sleeve member 30 that terminate in the tangs 43, 44. The slot extensions 46 reduce the spring force which must be overcome in displacing the tangs 43, 44 when the slightly larger side handle 18 is inserted and withdrawn. Thus, the baton 14, once inserted with its principal length axial within the sleeve member 30 and the side handle 18 within the side socket 40 or 41, is securely held by the tangs 43, 44. When needed, however, the baton 14 can be withdrawn manually, by using one hand only for most individuals.

Figure 6:
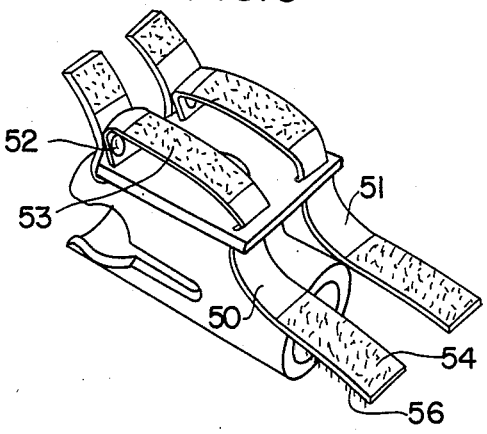
FIGS. 6 and 7 are perspective views of different steps employed in securing the baton holder, FIGS. 1–3, to the belt of the wearer.
Figure 7:
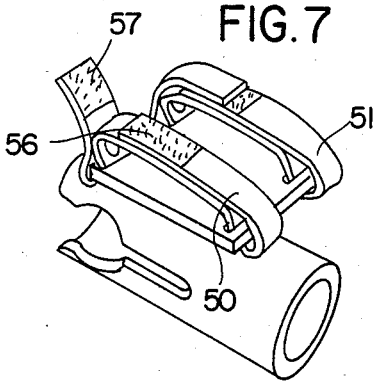

For securing the baton holder 10 to the belt 12 of the wearer, lengths of webbing 50, 51 are threaded through the slots 26 in the base support 20. For secure mounting the webbings 50, 51 include "VELCRO" fastener materials. As best seen in FIGS. 6 and 7, a loop near one end of a webbing 50 is secured through a slot 26 by rivets 52, the major length of the webbing 50 being passed around the belt 12 (as in FIG. 2) and through the other slot 26. Inside the belt 12, a length of "VELCRO" hook material 53 provides a base for a length of "VELCRO" loop material 54 on the opposing surface of the webbing end when the long end is folded back onto the hook material 53. In this position an area of hook material 56 is presented to the inside, relative to the wearer, as seen in FIG. 7 particularly. The second, short end of the webbing 50 includes an area of "VELCRO" loop material 57 that is fiolded over the hook material area 56 as a final seal. Thus when the webbing 50 is folded in this double loop fashion, with a final overlap and engagement of the free ends, the support 20 is firmly fixed to the belt 12.

Turning both ends of webbing 50 about the corners of the base support 20 through the slots 26 provides friction that aids in secure retention. Also the fact that the webbings 50, 51 press against the body of the wearer further secures them against release despite strains that may be placed on the belt 12, baton 14 and sleeve member 30.

Figure 10:
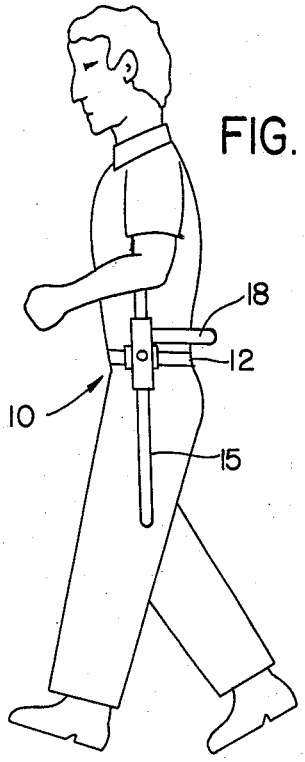
FIGS. 10, 11 and 12 are diagrammatic representations of different positions in which the baton may be placed by the wearer for use under different circumstances by the wearer.
Figure 11:
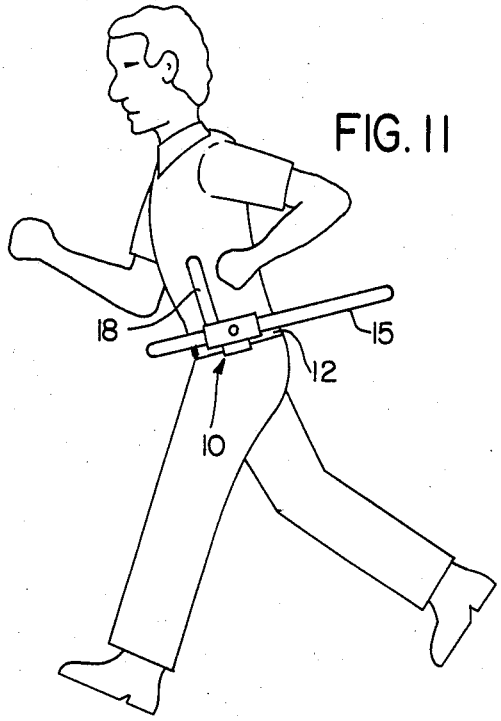
Figure 12:
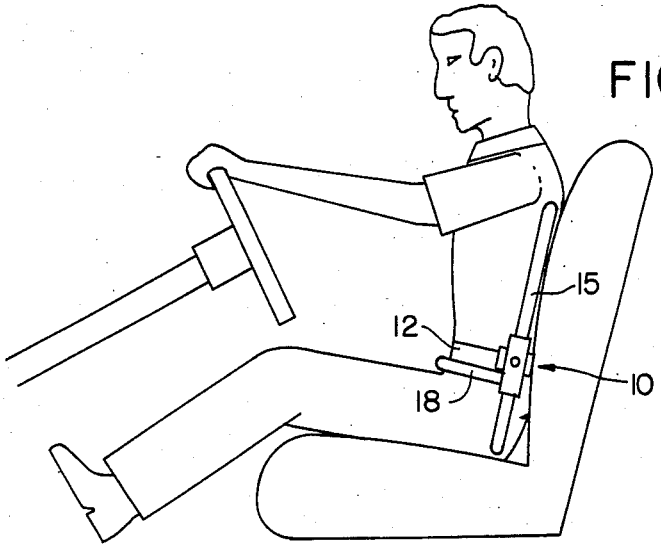

As seen in FIGS. 10, 11 and 12, this arrangement allows the wearer to place the baton 14 in any angular position, such as with the principal length 15 depending downwardly and the side handle 18 protruding backwardly (FIG. 10). To run, the wearer need only to rotate the principal length 15 to the horizontal position, as shown in FIG. 11, which position may also be used when the officer must go on all fours. For maintaining a low profile, or for sitting in a patrol vehicle, the principal length 15 can be rotated to the vertical orientation shown in FIG. 12, so as to lie along the back of the officer.

If the side handle 18 interferes with or is inconvenient to grasp in the position shown under given circumstances, the baton 14 can be reversed with the side handle in the second side socket 41.

Figure 13:
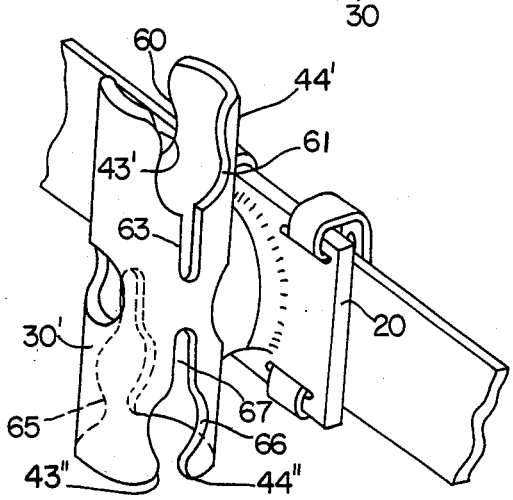
FIG. 13 is a perspective view of an alternative baton holder, which may be used for either of two different sizes of side handle batons.

Both ends of a sleeve member 30' can be used to accommodate different side-handle baton models, as shown in FIG. 13. Here the sleeve memvber 30' is configured as previously described, with first and second side sockets 60, 61 adjacent one end of the sleeve member 30', each including opposed tangs 43', 44', and a slot extension 63, as previously described. Another pair of side sockets 65, 66 are disposed in like manner adjacent the opposite end of the member 30'. These have a different principal diameter than the first pair of side sockets 60, 61 to accommodate baton having a side handle of different diameter. A slot extension 67 on the second side sockets 65, 66 provides the degree of spring compliance for the associated tangs 43", 44". The slot extensions 63, 67 are shorter than in the prior example of FIGS. 1–5, and assuming the same wall thickness for the sleeve member 30', are therefore made wider to achieve the same degree of resiliency. The axial aperture for the principal length of the baton is dimensioned to provide a sliding fit for the largest diameter of baton, and, if the other model of baton has a smaller diameter for its principal length, there may be a slight looseness which can be overcome by placing a small ring on the smaller sized baton (not shown).

While there have been shown above and illustrated in the drawings various forms and expedients in accordance with the invention, it will be appreciated that the invention is not limited thereto but encompasses all variations and alternatives within the scope of the appended claims.

What is claimed is:

1. A baton holder for a side handle baton for law enforcement applications comprising:

base means including means for attaching to a waist belt;

mounting means coupled to the base means and defining a pivot axis extending therefrom; and baton retention means disposed on the mounting means to pivot about the pivot axis to a selected position, said baton retention means including sleeve means for receiving a length of the baton in a direction perpendicular to the pivot axis, said sleeve means including resilient means comprising a bifurcated end section creating a deformable gap for receiving the side handle in secured but manually releasable manner.

2. The invention as set forth in claim 1 above, wherein the baton retention means comprises a sleeve member having an in-line aperture and side apertures in communication therewith, the side apertures defining an edge opening smaller than the diameter of the side handle of the baton and the sides of the sleeve member defining the opening being resiliently spreadable under manual force to secure and release the baton.

3. The invention as set forth in claim 1 above, wherein the mounting means comprises means for frictionally restraining the baton retention means against pivoting movement with a restraint force sufficient to permit pivoting due to the mass of the baton under normal conditions of movement but which may be manually overcome to select different attitudes of the baton retention means relative to the base means.

4. The invention as set forth in claim 3 above, wherein the base means and baton retention means have engaging frictional surfaces about the pivot axis and the mounting means comprises adjustable means for determining the bearing force between the frictional surfaces.

5. The invention as set forth in claim 4 above, wherein the mounting means comprises a bolt having a threaded end and a nut thereon coupling the baton retention means to the base means, and a spring means disposed adjacent the nut and compressed thereby.

6. The invention as set forth in claim 5 above, wherein the bolt has a head end embedded in the baton retention means, the engaging frictional surfaces comprise end faces of bosses on each of the base means and baton retention means, the end faces lying concentric with the pivot axis and in a plane normal thereto, and wherein the baton retention means comprises a thick-walled plastic element.

7. The invention as set forth in claim 1 above, wherein the baton retention means comprises a substantially cylindrical sleeve having an in-line aperture therethrough for receiving the principal length of the baton, the sleeve having at least one side socket adjacent one end thereof for receiving the side handle, the side socket being open to the end and the end of the sleeve including a pair of spaced apart tangs nominally spaced apart by a distance less than the side handle diameter, the sleeve further including a slot extension in the wall thereof from the side socket to control the resiliency of the wall against spreading forces exerted on the tangs.

8. The invention as set forth in claim 7 above, wherein the sleeve includes a pair of like side sockets on diametrically opposed portions of the wall thereof.

9. The invention as set forth in claim 8 above, wherein the sleeve includes two pairs of side sockets, one pair adjacent each end thereof, the diameters of the side sockets and the spacings between the tangs being selected to receive and resiliently secure side handle batons having side handles of different diameters.

10. The invention as set forth in claim 1 above, wherein the means for attaching to a waist belt includes webbing means attached to the base means and releasably encompassing the belt.

11. The invention as set forth in claim 10 above, wherein the base means comprises a rectangular member including slots adjacent opposite edges thereof adjacent the top and bottom of a waist belt, and wherein the webbing means extends through both slots and about the belt, against the wearer, and includes "Velcro" fastening means for releasably engaging the ends of the webbing means.

12. The invention as set forth in claim 11 above, wherein the member includes a pair of web members, each including means providing a loop secured about one slot, and a short end length extending therefrom, a principal length passing over the waist belt and through the second slot, a folded back end bearing against the principal length and engaged thereto by "Velcro" areas, and a "Velcro" coupling releasably securing the short end length to the folded back end.

13. A holder device for receiving a side handle law enforcement baton and securely holding the baton in different attitudes relative to the belt of an officer while permitting ready release for use, comprising:

base plate means having a side surface for engagement to the belt and an opposite side surface including a boss protruding outwardly about an axis normal to the belt, the base plate means including webbing means attached thereto for securing the base plate means to the belt;

generally cylindrical sleeve means having a side boss in engagement with the boss of the base plate means, the sleeve means including an axial through aperture for receiving a length of the baton shaft, a bifurcated end section of said sleeve including an aperture means in a side wall thereof defining a socket for receiving the baton side handle when the baton shaft is within said axial aperture, said socket further including a deformable gap between opposed edges at one end of said sleeve means, the gap being less than the diameter of the side handle such as to contain the baton against movement but being spreadable under manually exertable force to permit withdrawal of the baton; and means including friction introducing means rotatably coupling the sleeve means to the base plate means, about the axis normal to the belt, the friction introducing means restraining pivoting movement of the sleeve means and inserted baton sufficiently to remain in position in any attitude despite movement of the wearer, while still being below the restraint level at which the baton and pivot can be manually adjusted to any rotational position about the given axis.

14. The invention as set forth in claim 13 above, wherein the baton has a principal length along an in-line axis and a side handle normal thereto, and wherein the sleeve means includes a pair of oppositely disposed side handle receiving sockets in the wall thereof adjacent one end thereof, the sockets being slot extensions in the direction away from the end to reduce the spreading force needed to withdraw or insert the baton.

15. The invention as set forth in claim 14 above, wherein the friction introducing means comprises an attachment bolt and nut securing the sleeve means to the base plate means, and further including compressible spring means for maintaining frictional bearing force, and wherein the base plate means and sleeve means are of non-conductive, sound deadening material.

16. The invention as set forth in claim 15 above, wherein the webbing means comprises a length of material having at least two releasably engaging pairs of "Velcro" material, and wherein the attachment bolt head end is embedded in the sleeve means and includes a threaded end extending partially through the base plate means, wherein the base plate means includes a countersink depression on the side opposite the sleeve means and about the threaded end, and wherein the spring means comprises Belleville springs.

17. A baton holder for a side handle baton for law enforcement applications comprising:

base means including means for attaching to a waist belt;

mounting means coupled to the base means and defining a pivot axis extending therefrom; and baton retention means disposed on the mounting means to pivot about the pivot axis to a selected position, said baton retention means including sleeve means for receiving the baton in a direction perpendicular to the pivot axis, said sleeve means including a bifurcated end section forming a tubular resilient clamp comprising a deformable gap with an axis perpendicular to the axis of said sleeve and said pivot axis for receiving the baton side handle in secured but manually releasable manner.

* * * * *